US012527443B2

(12) United States Patent
Matsuo et al.

(10) Patent No.: US 12,527,443 B2
(45) Date of Patent: Jan. 20, 2026

(54) WET SHEET DISPENSING DEVICE

(71) Applicant: MATSUO INDUSTRIES, INC., Nagoya (JP)

(72) Inventors: Motoi Matsuo, Obu (JP); Yuji Sekitomi, Obu (JP); Mikiya Ichikawa, Obu (JP); Kazushi Akutsu, Obu (JP); Noriyuki Heike, Obu (JP)

(73) Assignee: MATSUO INDUSTRIES, INC., Nagoya (JP)

( * ) Notice: Subject to any disclaimer, the term of this patent is extended or adjusted under 35 U.S.C. 154(b) by 674 days.

(21) Appl. No.: 17/911,262

(22) PCT Filed: Jan. 21, 2021

(86) PCT No.: PCT/JP2021/002073
§ 371 (c)(1),
(2) Date: Sep. 13, 2022

(87) PCT Pub. No.: WO2021/181904
PCT Pub. Date: Sep. 16, 2021

(65) Prior Publication Data

US 2023/0102281 A1 Mar. 30, 2023

(30) Foreign Application Priority Data

Mar. 13, 2020 (JP) ..... 2020-043898

(51) Int. Cl.
*A47K 10/36* (2006.01)
*A47K 10/32* (2006.01)

(52) U.S. Cl.
CPC ..... *A47K 10/36* (2013.01); *A47K 2010/3226* (2013.01); *A47K 2010/3266* (2013.01); *A47K 2010/3668* (2013.01)

(58) Field of Classification Search
CPC ..... A47K 2010/3266; A47K 10/38; A47K 10/3687; A47K 10/32; A47K 10/3606;
(Continued)

(56) References Cited

U.S. PATENT DOCUMENTS 11,051,663 B1 * 7/2021 Danis ..... A47K 10/3612
11,986,134 B2 * 5/2024 Matsuo ..... A47K 7/00
(Continued)

FOREIGN PATENT DOCUMENTS

JP 2000-287872 A 10/2000
JP 2002-515273 A 5/2002
(Continued)

OTHER PUBLICATIONS

International Search Report and Written Opinion issued on Mar. 30, 2021 in corresponding International application No. PCT/JP2021/002073; 9 pages.

*Primary Examiner* — Timothy R Waggoner
(74) *Attorney, Agent, or Firm* — Maier & Maier, PLLC

(57) ABSTRACT

A wet sheet with a predetermined length is securely provided while drying is prevented. When a motor control part receives a detection signal from a hand hovering sensor, a motor is driven from a standby state to rotate a driving roller. When a cutting line is detected by a cutting line detecting sensor, the driving of the motor is continued until a predetermined time set beforehand in which the detected cutting line reaches the side downstream of a contact point between the driving roller and a driven roller in terms of the feeding direction has elapsed, to be stopped. The detected cutting line is located downstream of the contact point between the driving roller and the driven roller in terms of the feeding direction. In front of the detected cutting line, the wet sheet for one sheet is present and is detected by the sheet detecting sensor.

6 Claims, 13 Drawing Sheets

(58) Field of Classification Search
CPC ..... A47K 10/3637; A47K 2010/3233; A47K 2010/3286; A47K 7/00; A47K 10/26; A47K 10/3643; A47K 2010/3253; A47K 2010/326; A47K 2010/328; A47K 2010/3675; A47K 2010/3881
See application file for complete search history.

(56) References Cited

U.S. PATENT DOCUMENTS

| | | | | |
|---|---|---|---|---|
| 2009/0065628 | A1* | 3/2009 | Troutman | A47K 10/36 242/564.1 |
| 2011/0308451 | A1* | 12/2011 | Kaufmann | A47K 10/32 118/235 |
| 2016/0353946 | A1* | 12/2016 | Osborne, Jr. | B65H 16/005 |
| 2020/0205621 | A1* | 7/2020 | Osborne, Jr. | A47K 10/36 |
| 2021/0196086 | A1 | 7/2021 | Matsuo et al. | |

FOREIGN PATENT DOCUMENTS

| | | | |
|---|---|---|---|
| JP | 2004-505743 | A | 2/2004 |
| JP | 2012-070887 | A | 4/2012 |
| JP | 2014196112 | A | 10/2014 |
| JP | 2016116637 | A | 6/2016 |
| WO | 9959457 | A1 | 11/1999 |
| WO | 0060990 | A1 | 10/2000 |
| WO | 0215763 | A1 | 2/2002 |
| WO | 03/078286 | A1 | 9/2003 |
| WO | 2020040083 | A1 | 2/2020 |

* cited by examiner (a)

(b)

(a)

(b)

WET SHEET DISPENSING DEVICE

TECHNICAL FIELD

The present invention relates to a device that dispenses a wet sheet used to wipe hands and the like.

BACKGROUND

Wet sheets (including those called wet tissues, wet wipes, wet towels, and the like) made of paper, nonwoven fabric, or the like impregnated with a liquid chemical that are used for wiping hands or the like are typically stacked and stored in plurality in a bag body, and at the time of the use, a lid member provided on an opening of the bag body is opened/closed and the wet sheets are taken out sheet by sheet, as is disclosed in Japanese Patent Application Laid-open No. 2014-196112. However, in the case where the stacked wet sheets stored in the bag body are taken out sheet by sheet from the opening, a user needs to hold the bag body with his/her hand because the bag body moves up with the wet sheet that is tried to be taken out. Accordingly, in a case where the bag body is installed in restrooms, washrooms, on dining tables, and the like in places where many unspecified people gather, such as public facilities, hospitals, hotels, department stores, restaurants, parks, trains, and airplanes, the user may feel hesitant to hold the bag body or the like with his/her hand because of a hygienic reason.

In consideration of the above, the present applicant has proposed, in Japanese Patent Application Laid-open No. 2016-116637, a sheet dispenser that automatically dispenses a plurality of wet sheets in a folded and stacked state sheet by sheet. According to this sheet dispenser, a user need not hold a case of the sheet dispenser and can pick up only the wet sheet transferred to an outlet. This is hygienic and enables the user to easily take the wet sheet even in a situation where only one hand is available.

Further, the present applicant has proposed, in International Publication WO 2020/040083 A1, a sheet dispensing device in which a rolled wet sheet provided with cutting lines (perforations) at predetermined intervals is used, and by holding a hand thereover, the wet sheet is pulled out automatically by a predetermined length, and a user pulls down and takes out it.

SUMMARY

From the sheet dispenser disclosed in Japanese Patent Application Laid-open No. 2016-116637, a user can take the wet sheet easily and hygienically as described above, but since a certain number of the stacked wet sheets are picked up at a time, an adjusting mechanism or the like is necessary when their bulk becomes small and the structure tends to be complicated. Further, since the wet sheet is transferred up to a receiving tray disposed at the outlet and the user picks up the wet sheet on the receiving tray with his/her hand, the hand may touch the receiving tray at this time, leaving room for further improvement from a hygienic viewpoint.

Meanwhile, in International Publication WO 2020/040083 A1, which eliminates the problems in Japanese Patent Application Laid-open No. 2016-116637, a rolled wet sheet is used, and when a hand hovering sensor detects a hand, a sheet with a predetermined length is pulled out downward from a sheet dispensing port to be in a state of hanging from the sheet dispensing port. The user pulls the hanging part, thereby cutting the wet sheet for use from the cutting line (perforations), which allows him/her to use it.

Accordingly, it is only the user that touches the wet sheet pulled out from the sheet dispensing port with his/her hand or the like, which is hygienic.

In International Publication WO 2020/040083 A1, a feed amount of the wet sheet is controlled based on only a sensor which detects the cutting line (perforations) (cutting line detecting sensor). That is, a driving roller is rotated by driving of a motor, the wet sheet is discharged by its traction, and the driving of the motor is stopped at the time of detecting the next cutting line. International Publication WO 2020/040083 A1 discloses a form of providing the cutting line detecting sensor in the vicinity of the sheet dispensing port below the driving roller, and a form of providing the cutting line detecting sensor above the driving roller.

However, in the former form, since the cutting line detecting sensor is provided at a position where tractive force in a feeding direction does not act after passing between the driving roller and a driven roller facing it, openings of the cutting line (perforations) open poorly, which makes a frequency with which the cutting line detecting sensor fails to detect the cutting line relatively high. Moreover, since the tractive force does not act, wet sheets subsequent to the wet sheet passed between the driving roller and the driven roller do not always vertically hang stably, and some distortions or twists sometimes also occur, resulting in that the former is not always said to be suitable for the detection of the cutting line.

Meanwhile, in the latter form, since the cutting line is detected at a position to which tension is applied through the traction downstream in terms of the feeding direction by the driving roller, a detection error of the openings is less than that in the former form. However, a position where the wet sheet discharged from the sheet dispensing port is pulled to be cut is from the cutting line after passing through the contact point between the driving roller and the driven roller. Accordingly, in a case of attaching the cutting line detecting sensor upstream of the driving roller, after detecting the front cutting line, at the time of detecting the next cutting line to stop the motor, the front cutting line is to be at a position after passing through the contact point between the driving roller and the driven roller.

Moreover, as the latter form disclosed in International Publication WO 2020/040083 A1, it is described that a sheet detecting sensor is provided downstream of the contact point between the driving roller and the driven roller, and judges a failure to detect the wet sheet to be the occurrence of a lack of sheets or a feed error, thereby displaying the errors. This is preferable for allowing a quick response to the occurrence of such errors, and at the time of normal operation, the wet sheet is required to be always present downstream of an attachment position of the sheet detecting sensor.

Therefore, in an attempt to satisfy two conditions in which at the time of stopping the motor by detecting the next cutting line at the cutting line detecting sensor, the position of the front cutting line is downstream of the contact point between the driving roller and the driven roller, and the presence of the wet sheet can be confirmed by the sheet detecting sensor, the entire range of the one wet sheet sandwiched between the two cutting lines is required to be located downstream of the contact point between the driving roller and the driven roller in a standby state before the user holds his/her hand over the hand hovering sensor. As a result, a length corresponding to the projection from the sheet dispensing port also increases, which easily causes drying in the standby state. For example, when a length of one wet sheet (an interval between adjacent cutting lines) is set to 150 mm, and a length from the contact point between the driving roller and the driven roller to the sheet dispensing port is set to 50 mm, in the standby state, the wet sheet projects from the sheet dispensing port by at least 100 mm, and correspondingly, a direct exposure to outside air, air from an air conditioner, or the like makes early progress of drying easy. To avoid this situation, for example, a casing is considered to have such a size as to prevent the wet sheet from projecting from the sheet dispensing port by making a distance from a pullout port of a sheet cartridge holding the rolled wet sheet to the sheet dispensing port longer, which increases a size of the casing. This tendency becomes more noticeable as the interval between the cutting lines extends, and conversely, a rolled wet sheet suitable for use in a casing with a certain size is limited to one having an interval between the adjacent cutting lines within a predetermined range.

The present invention was made in consideration of the above and has an object to provide a wet sheet dispensing device capable of preventing the drying of the wet sheet in the standby state more than the conventional one, and moreover, capable of handling more various wet sheets in the intervals between the cutting lines on the rolled ones without increasing the size of the casing.

To solve the above problems, a wet sheet dispensing device of the present inventors includes:

a casing capable of housing, inside, a sheet cartridge housing a rolled wet sheet provided with a cutting line in a width direction at predetermined intervals, and having a pullout port from which the wet sheet is pulled out, and, including a sheet dispensing port which is formed at a predetermined height position to face downward and through which the wet sheet passes when fed out; and a sheet feeding mechanism which is provided in the casing, pulls the wet sheet out of the sheet cartridge from the pullout port, and feeds out the wet sheet with a predetermined length for use from the sheet dispensing port, and, dispenses the wet sheet with the predetermined length for use in a hanging state from the sheet dispensing port while holding a part located upstream of the sheet dispensing port in terms of a feeding direction of the wet sheet, the sheet feeding mechanism includes:

a driving roller and a driven roller which are disposed upstream of the sheet dispensing port in terms of the feeding direction of the wet sheet, and face each other to sandwich the wet sheet; and a drive control mechanism having a motor which rotates the driving roller in such a direction as to feed the wet sheet toward the sheet dispensing port, and having a feed amount control part which controls a feed amount of the wet sheet, the feed amount control part includes:

a hand hovering sensor;

a cutting line detecting sensor which is provided in a range from the pullout port of the sheet cartridge to a contact point between the driving roller and the driven roller, and detects the cutting line of the wet sheet;

a sheet detecting sensor which is provided in a range from the contact point between the driving roller and the driven roller to the sheet dispensing port, and detects presence or absence of the wet sheet in front of the detected cutting line; and a motor control part which, based on a detection signal from the hand hovering sensor, outputs a signal to drive the motor from a standby state, and after the cutting line detecting sensor detects the cutting line, when a predetermined time in which the detected cutting line reaches a range from the contact point between the driving roller and the driven roller to a detection position of the sheet detecting sensor has elapsed, outputs a signal to stop the driving of the motor, and the sheet detecting sensor detects the presence of the wet sheet in a state in which the wet sheet in front of the detected cutting line hangs from the sheet dispensing port, and in the standby state, is in a state of not detecting the presence of the wet sheet after the hanging wet sheet is taken by a user.

Preferably, an attachment position of the cutting line detecting sensor is set to a position which, at a maximum apart from the contact point between the driving roller and the driven roller, at a time of maximum feed resistance of the wet sheet, allows the detected cutting line to reach a side downstream of the contact point between the driving roller and the driven roller in terms of the feeding direction until the predetermined time in which the driving of the motor stops has elapsed after detecting the cutting line, and an attachment position of the sheet detecting sensor is set to a position which, at a minimum apart from the contact point between the driving roller and the driven roller, at a time of minimum feed resistance of the wet sheet, the detected cutting line reaches at a time when the predetermined time in which the driving of the motor stops has elapsed.

Preferably, at the sheet dispensing port, a shutter which closes the sheet dispensing port in the standby mode is provided.

Preferably, the wet sheet dispensing device includes a light irradiation part which irradiates the wet sheet hanging down from the sheet dispensing port with light while the sheet detecting sensor detects the presence of the wet sheet.

Preferably, a plurality of relay rollers for pullout which pull out the wet sheet substantially horizontally from the pullout port of the cover are disposed in parallel, and of the relay rollers, one closest to the pullout port is disposed to partially face the pullout port.

Preferably, the wet sheet dispensing device further includes a projection length abnormality detecting sensor which outputs a signal to stop the driving of the motor when a projection length of the wet sheet from the sheet dispensing port is equal to or longer than a predetermined length.

Preferably, the wet sheet dispensing device further includes an information processing part including:

a storage unit which stores device information including a using condition of the wet sheet and abnormality of operation; and a communication unit having a function of reading out the device information from the storage unit to transmit the device information to a management computer.

In the wet sheet dispensing device of the present invention, when the motor control part receives a detection signal from the hand hovering sensor, the motor is driven from the standby state to rotate the driving roller. Thereafter, when the cutting line is detected by the cutting line detecting sensor, the driving of the motor is continued until a predetermined time set beforehand in which the detected cutting line reaches the side downstream of the contact point between the driving roller and the driven roller in terms of the feeding direction has elapsed, to be stopped. Therefore, the detected cutting line is always located downstream of the contact point between the driving roller and the driven roller in terms of the feeding direction. At this time, in front of the detected cutting line, the wet sheet for one sheet is present, the presence thereof is detected by the sheet detecting sensor, and the wet sheet projects from the sheet dispensing port by a predetermined length. When a user pulls a part projecting from the sheet dispensing port, this wet sheet is cut from the above-described detected cutting line, which allows the user to take it for use. When this wet sheet is provided for the user, the sheet detecting sensor is in a state of not detecting the presence of the wet sheet, and until the motor control part receives the next detection signal from the hand hovering sensor, the wet sheet dispensing device is in the standby state in which the motor stops. Accordingly, in the standby state, the wet sheet is in a position which the sheet detecting sensor fails to detect, that is, the front edge of the next wet sheet is located downstream of the contact point between the driving roller and the driven roller and upstream of the sheet detecting sensor in terms of the feeding direction. Hence, in the standby state, the wet sheet does not project from the sheet dispensing port, which prevents drying of the wet sheet.

Further, the motor control part controls the motor to, after the cutting line detecting sensor detects the cutting line, be driven until the predetermined time set beforehand in which the detected cutting line reaches the side downstream of the contact point between the driving roller and the driven roller in terms of the feeding direction has elapsed, to be stopped. Accordingly, regardless of a length of the wet sheet for one sheet (an interval between adjacent cutting lines), a length from the contact point between the driving roller and the driven roller to the cutting line reaching the side downstream in terms of the feeding direction is approximately fixed, and the wet sheet does not project from the sheet dispensing port in the standby state either. Therefore, the wet sheet dispensing device of the present invention can handle, as rolled wet sheets, the ones having various lengths of the wet sheets for one sheet (intervals between the adjacent cutting lines) without increasing a size of the casing.

Further, in the present invention, the attachment position of the cutting line detecting sensor is preferably set to match the position which, at the maximum apart from the contact point between the driving roller and the driven roller, at the time of maximum feed resistance of the wet sheet, makes the detected cutting line reach the side downstream of the contact point between the driving roller and the driven roller in terms of the feeding direction.

For the rolled wet sheet, since water is retained therein, between immediately after the beginning of use at which the wet sheet is set and at the time when the remaining amount becomes small, a difference in weight is large, and feed resistances when the driving roller feeds the wet sheet in the feeding direction vary greatly between immediately after the beginning of use and at the time when the remaining amount becomes small. Therefore, when a rotation time of the motor is fixed, the rolled wet sheet has a characteristic in which as the remaining amount becomes smaller, a feed rate becomes significantly faster. As described above, in the present invention, the time is set so that, after detecting the cutting line, this detected cutting line is fed until reaching the side downstream of the contact point between the driving roller and the driven roller in terms of the feeding direction. However, when feed resistance is high, there is a possibility that the detected cutting line does not reach the side downstream of the contact point between the driving roller and the driven roller in terms of the feeding direction within this set time. On this point, the maximum separation distance from the contact point between the driving roller and the driven roller is set to be equal to or shorter than a distance which allows the cutting line to be fed at the time of maximum feed resistance, thereby allowing the prevention of occurrence of the above event.

On the other hand, the attachment position of the sheet detecting sensor is preferably set at the position which, at the minimum apart from the contact point between the driving roller and the driven roller, at the time of minimum feed resistance of the wet sheet, the detected cutting line reaches at the time when the predetermined time in which the driving of the motor stops has elapsed. When the minimum separation distance from the contact point between the driving roller and the driven roller is shorter than this distance, the time when the feed resistance becomes small to make the feed rate of the wet sheet fast causes a case where the position of the cutting line is downstream of the attachment position of the sheet detecting sensor. That is, the wet sheet detected by the sheet detecting sensor is the wet sheet immediately behind the detected cutting line, and even though the wet sheet immediately in front of the detected cutting line is cut out, the sheet detecting sensor continues detecting the presence of the wet sheet immediately therebehind. Therefore, the sheet detecting sensor continues judging that the wet sheet is not cut out, and keeps a state of waiting for the wet sheet to be taken, resulting in that the device fails to make transition to the standby state. However, according to the present invention, since the attachment position of the sheet detecting sensor is at a position equal to or longer than a distance which the cutting line reaches at the time of minimum feed resistance, that is, at the fastest feed rate of the wet sheet, the absence of the wet sheet can be detected securely when the wet sheet projecting from the sheet dispensing port is cut out from the cutting line. Consequently, it is possible to contribute to prevention of a malfunction.

DETAILED DESCRIPTION OF THE EMBODIMENTS

Embodiments of the present invention will be hereinafter described in more detail based on the drawings. As illustrated in FIG. 1 to FIG. 7, a sheet dispensing device 1 of this embodiment includes a casing 10 and a sheet feeding mechanism 20.

Figure 1:
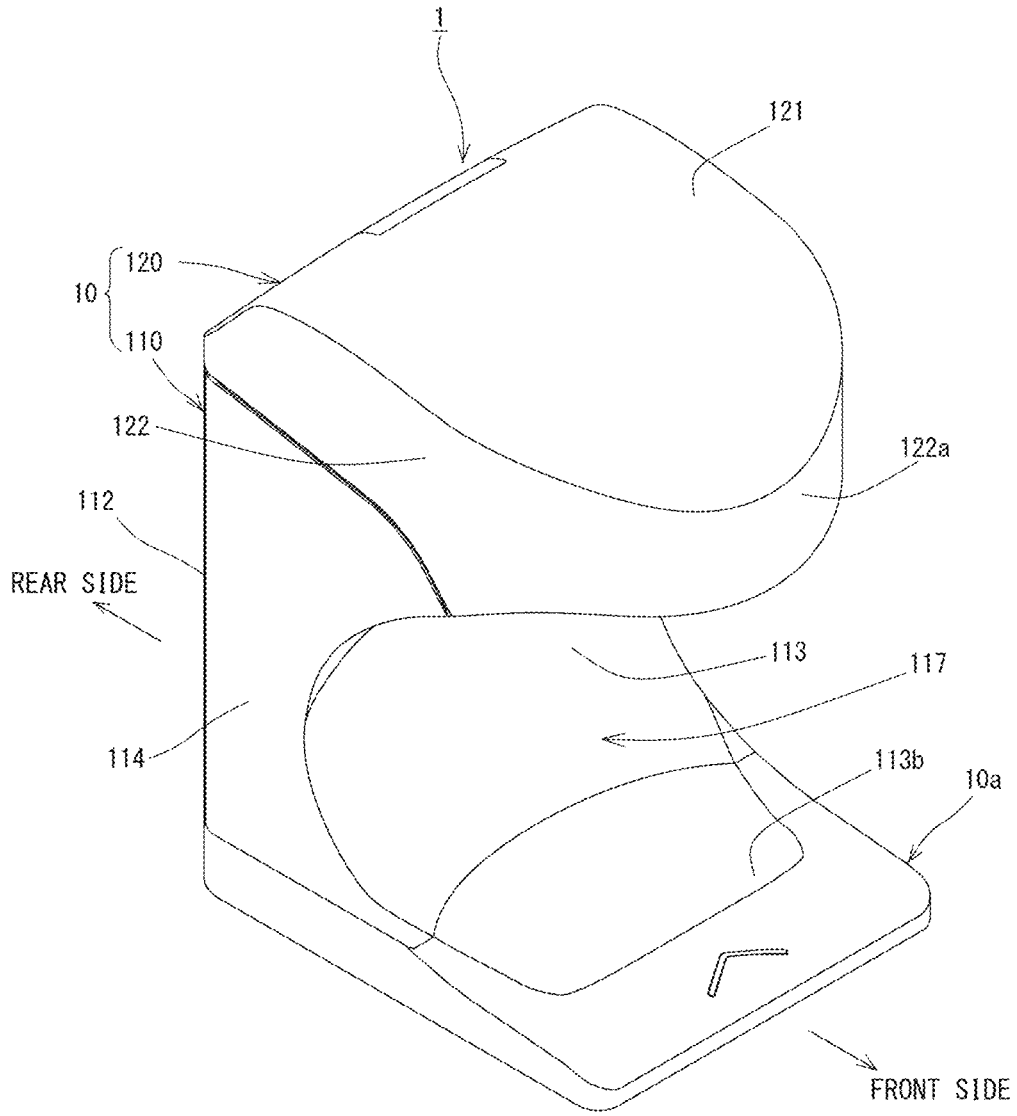
FIG. 1 is a perspective view illustrating the outer appearance of a sheet dispensing device according to one embodiment of the present invention seen from a front upper direction.
Figure 2:
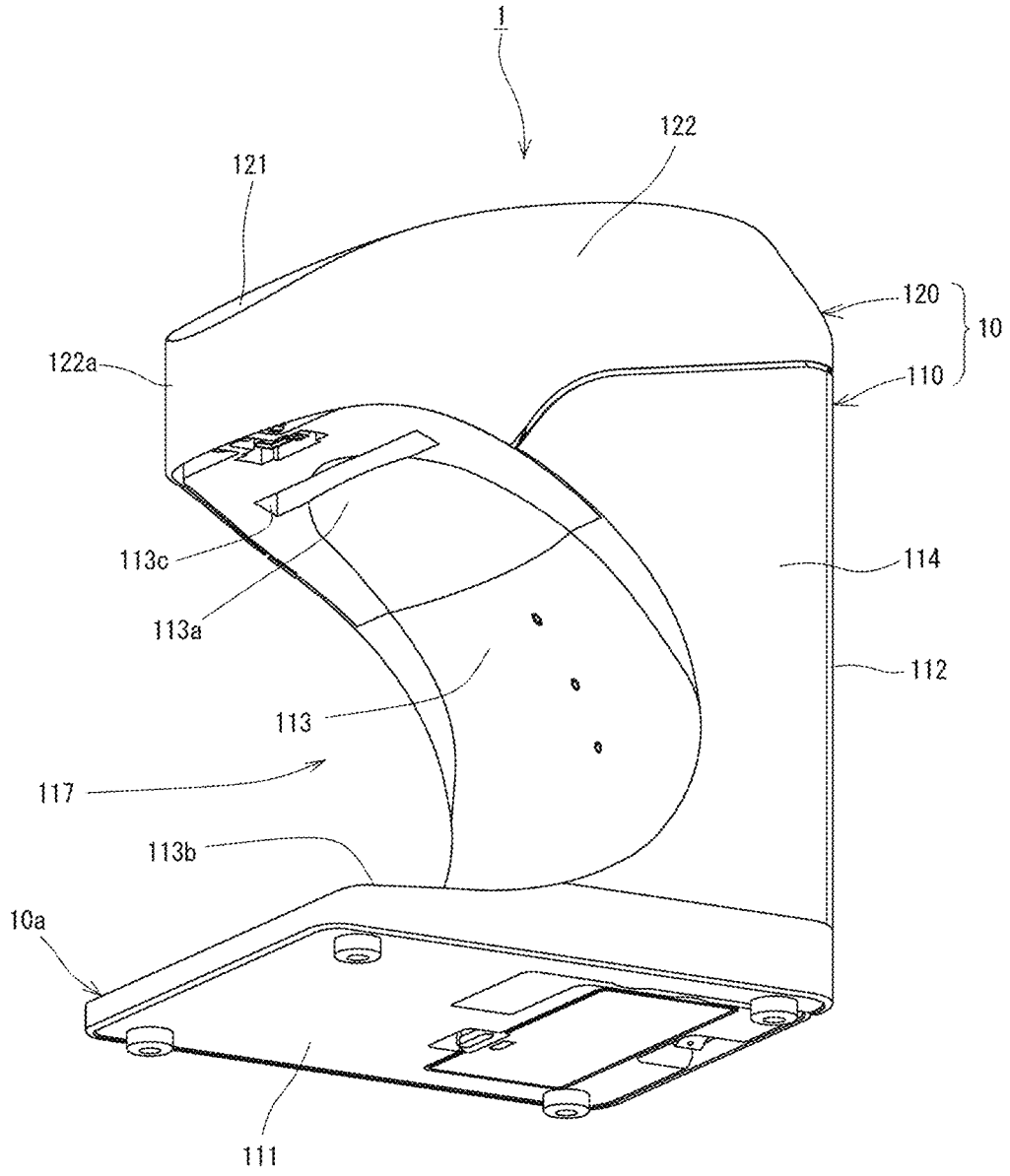
FIG. 2 is a perspective view illustrating the outer appearance of the sheet dispensing device in FIG. 1 seen from a front lower direction.

The casing 10 includes a main body case 110 and a lid 120. As illustrated in FIG. 1 and FIG. 2, outwardly, the main body case 110 has a substantially rectangular shape that is slightly longer in the height direction in a front view and a rear view, and is in a substantially rectangular shape that is slightly longer in the front-rear direction in a plan view and a bottom view. On the other hand, in a side view, it has a shape cut out in an arc shape from the front side toward the rear side. Specifically, it is formed in a hollow shape that is surrounded by a bottom surface 111 in a substantially rectangular shape that is slightly longer in the front-rear direction in a plan view, a substantially rectangular rear surface 112 rising on the rear side of the bottom surface 111 substantially vertically to the bottom surface 111, a curved front surface 113 located on the front side and formed substantially in a C shape with its heightwise substantially middle portion curving rearward, and side surfaces 114, 114 covering side portions of the rear surface 112 and the curved front surface 113, and that has an opening 115 in an upper surface.

In this structure, in the curved front surface 113, a portion above the substantially heightwise middle portion is an upper projecting surface 113*a* that gradually projects forward and a portion under the substantially heightwise middle portion is a lower projecting surface 113*b* that gradually projects more forward as it goes toward the bottom surface 111 and covers the bottom surface 111. Accordingly, in front of the curved front surface 113, a front-side space 117 dented rearward substantially in an arc shape is formed between the upper projecting surface 113*a*, of the curved front surface 113, projecting forward and the bottom surface 111. Further, in the upper projecting surface 113*a* of the curved front surface 113, a sheet dispensing port 113*c* facing downward, that is, facing the front-side space 117 is formed in a slit shape in the width direction (see FIG. 2). Note that the bottom surface 111 and the lower projecting surface 113*b* covering it serve as a base 10*a* when the casing 10 is put on a table, a washstand or the like.

As illustrated in FIG. 3 to FIG. 7, in the main body case 110, a sheet cartridge 130 is stored through the opening 115. The sheet cartridge 130 has a cover 131 which is substantially rectangular parallelepiped-shaped as a whole, and a rolled sheet (wet sheet S in this embodiment) is stored in the cover 131 (see FIG. 7).

In the cover 131, a slit-shaped pullout port 131*a* extending in a substantially horizontal direction is formed at its part on the front side of the main body case 110 (see FIG. 4 and FIG. 5), and a leading edge of the wet sheet S faces the pullout port 131*a* so that the wet sheet S can be pulled out. The cover 131 except the pullout port 131*a* is airtightly closed.

Figure 3:
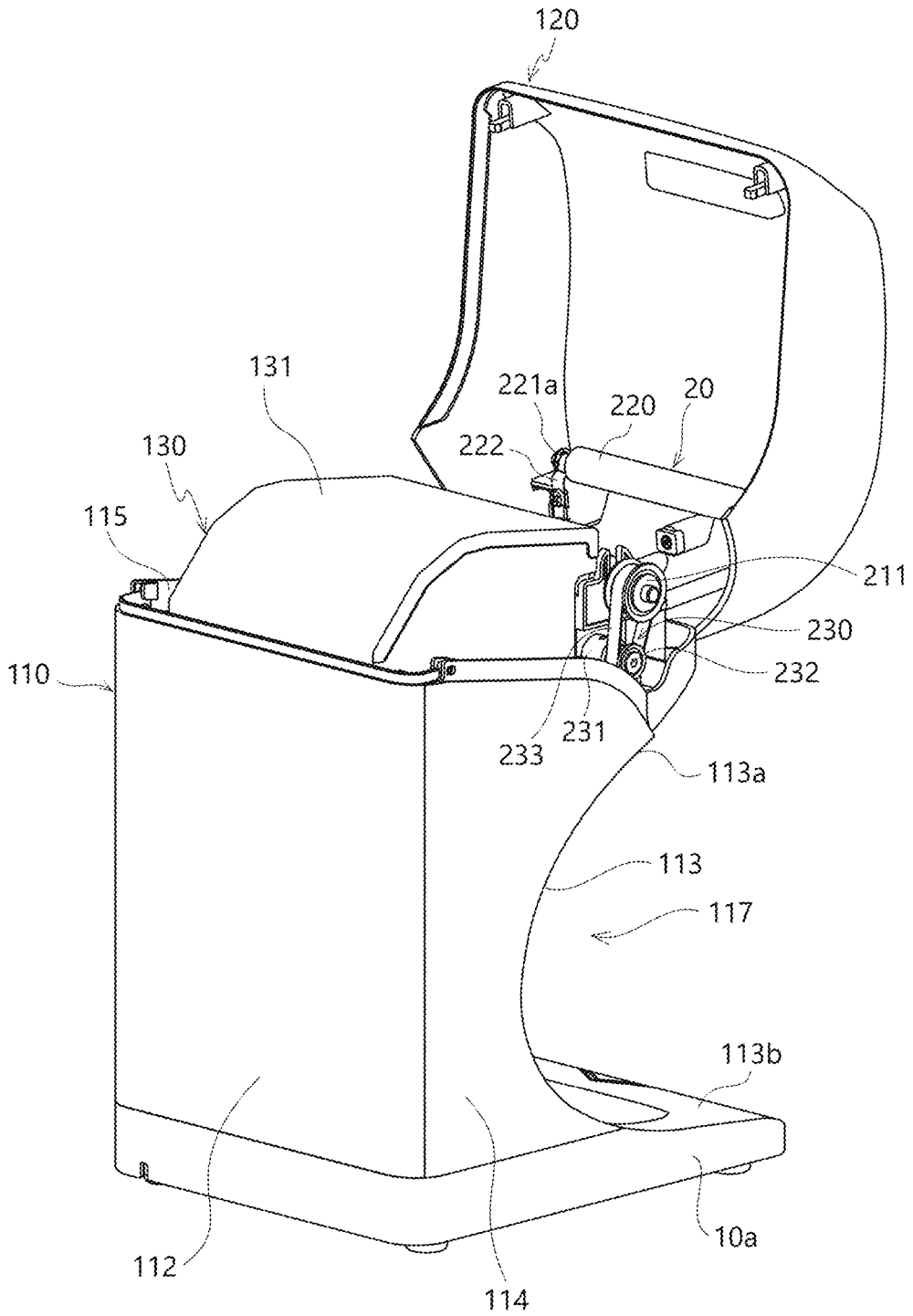
FIG. 3 is a perspective view illustrating the internal structure of the sheet dispensing device of the embodiment with its lid being opened.
Figure 7:
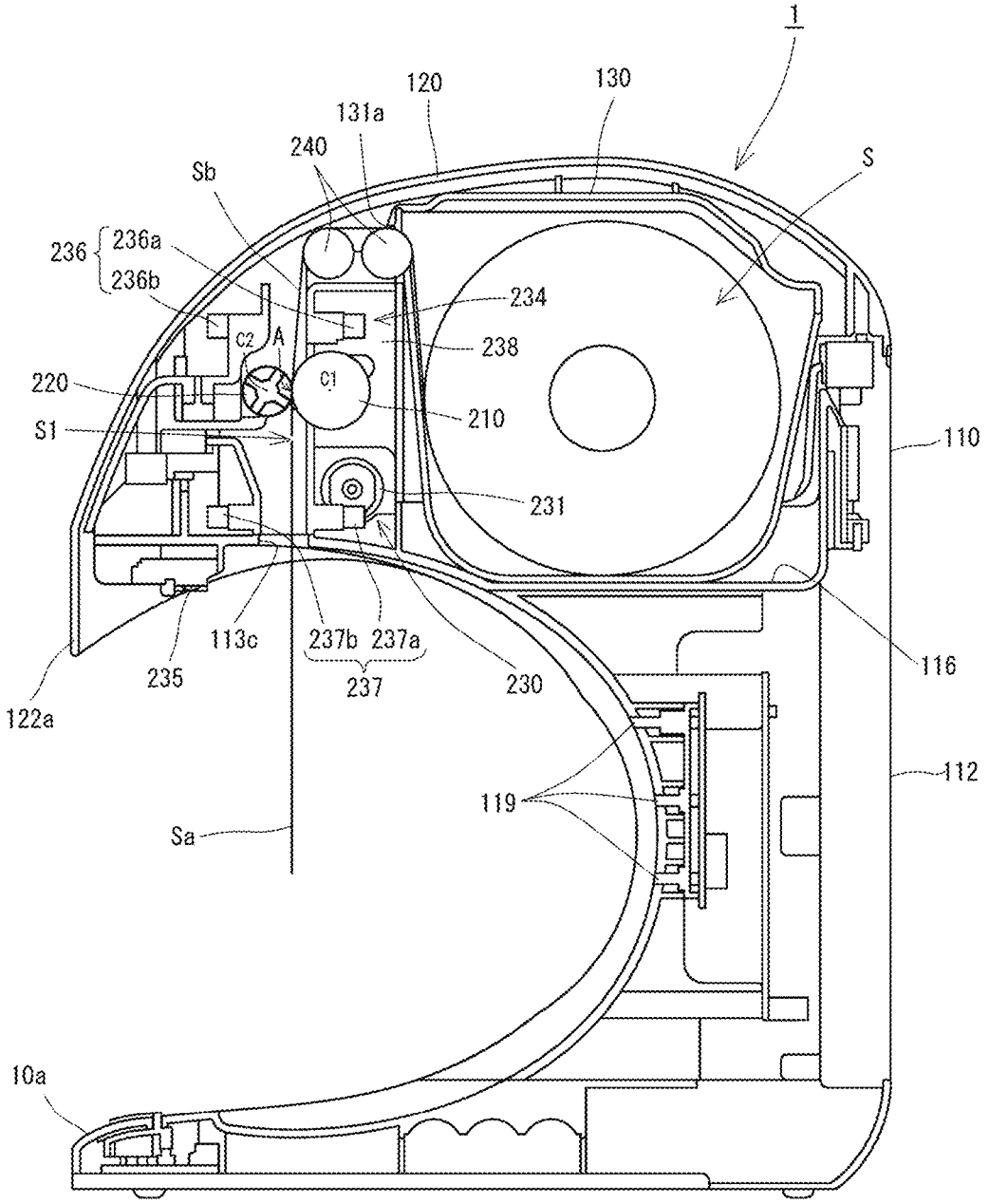
FIG. 7 is a sectional view of the wet sheet dispensing device.

As illustrated in FIG. 3, from the position of the rear surface 112 of the main body case 110, the front-rear direction length of the sheet cartridge 130 is shorter than the length of the lid 120 up to its tip position (position of a front plate 122*a* located on the front side), and the sheet cartridge 130 is placed on a sheet placement part 116 provided closer to the rear surface 112 in the main body case 110 (see FIG. 7).

The lid 120 is large enough to cover, from above, the wet sheet S that is present at least in a range from the pullout port 131*a* of the sheet cartridge 130 from which the wet sheet S has been pulled out up to the sheet dispensing port 113*c*. This makes it possible to cover the wet sheet S exposed from the sheet cartridge 130 in the main body case 110 to prevent the wet sheet S in this range from becoming dry. In this embodiment, the lid 120 has a top plate 121 in a substantially rectangular shape whose front side is substantially in an arc shape in a plan view and a peripheral wall 122 extending from the periphery of the top plate 121 toward the opening 115 of the main body case 110 to be joinable to the peripheral edge of the opening 115 of the main body case 110. In the peripheral wall 122 of the lid 120, the vicinity of a lower portion of the front plate 122*a* located on the front side is pivotally supported by and attached to the vicinity of a front end of the upper projecting surface 113*a* of the main body case 110. Therefore, as illustrated in FIG. 3, the lid 120 can be opened/closed around the vicinity of the lower portion of the front plate 122*a* such that it separates more from the peripheral edge of the opening 115 of the main body case 110 as it goes toward the rear plate 122*b* of the peripheral wall 122.

The sheet feeding mechanism 20 includes a driving roller 210, a driven roller 220, and a drive control mechanism 230 and is provided in the casing 10. The driving roller 210 and the driven roller 220 are disposed upstream of the sheet dispensing port 113*c* in terms of the sheet feeding direction of the wet sheet S (close to the pullout port 131*a* of the sheet cartridge 130) and in this embodiment, they are disposed in a region from the pullout port 131*a* of the sheet cartridge 130 up to the sheet dispensing port 113*c* of the main body case 110 (see FIG. 3 to FIG. 7). Further, in this embodiment, the driving roller 210 is rotatably supported between the side surfaces 114, 114 in the main body case 110 at a position above the sheet dispensing port 113*c*. Further, the drive control mechanism 230 which rotates the driving roller 210 is also provided in the main body case 110 in this embodiment. The drive control mechanism 230 has a motor 231 and a feed amount control part 234. The drive control part 230 also includes a transmission belt 233 wound between a motor-side pulley 232 which is coupled to an output shaft of the motor 231 and a roller-side pulley 211 which is provided on the driving roller 210, and transmits the rotational force of the motor 231 to the driving roller 210 through these.

The driven roller 220 rotatably extends along the width direction at a position close to the front plate 122*a* of the peripheral wall 122 of the lid 120. Further, as illustrated in FIG. 7, the driven roller 220 is provided at a position where it faces the driving roller 210 when the lid 120 is closed, and is biased by elastic members in a direction in which it approaches the driving roller 210. Specifically, as illustrated in FIG. 3, end portions 221*a* of a rotary shaft 221 of the driven roller 220 are rotatably supported by leaf springs 222 as the elastic members which are provided apart from each other in the width direction near the inner sides of the peripheral wall 122 of the lid 120. The elastic force of the leaf springs 222 is set to act in such a direction as to make the driven roller 220 approach the driving roller 210 when the lid 120 is closed. It should be noted that the elastic members biasing the driven roller 220 in the direction in which the driven roller 220 approaches the driving roller 210 are not limited to these, and other springs such as coil springs, rubber, or the like are adoptable instead of the leaf springs 222.

Note that the wet sheet S is fed down while sandwiched between the driving roller 210 and the driven roller 220, to be discharged from the sheet dispensing port 113*c*, and the hanging wet sheet S is pulled down by a user to be provided for him/her, which is hygienic because it is only the user that comes into contact with this wet sheet S. In consideration of this point, it is preferable that an opening width of the sheet dispensing port 113*a* of this embodiment (a length in the width direction when the wet sheet dispensing device 1 is seen from the front) is larger than a width of the wet sheet S, and a depth-direction length in a direction orthogonal thereto is a size exceeding a thickness of the wet sheet S. This causes the wet sheet S hanging from the sheet dispensing port 113*c* to fail to come into contact with a peripheral edge portion of the sheet dispensing port 113*c*, which is hygienically preferable. For the same reason, also in a range of a feed path of the wet sheet S from a position of the driving roller 210 and the driven roller 220 sandwiching the wet sheet S up to the sheet dispensing port 113*c*, in a manner not to bring the wet sheet S into contact with its surrounding parts or the like, arrangement positions of these parts or the like are preferably set. Note that the wet sheet S is sandwiched between the driving roller 210 and the driven roller 220, held in a hanging posture, and provided for a user in the posture. Accordingly, since the wet sheet S takes a substantially vertical posture in the hanging state seen from a side direction in FIG. 7, in a position not to interfere with it, an opening position of the sheet dispensing part 113*c* and a feed path position are set.

Figure 6:
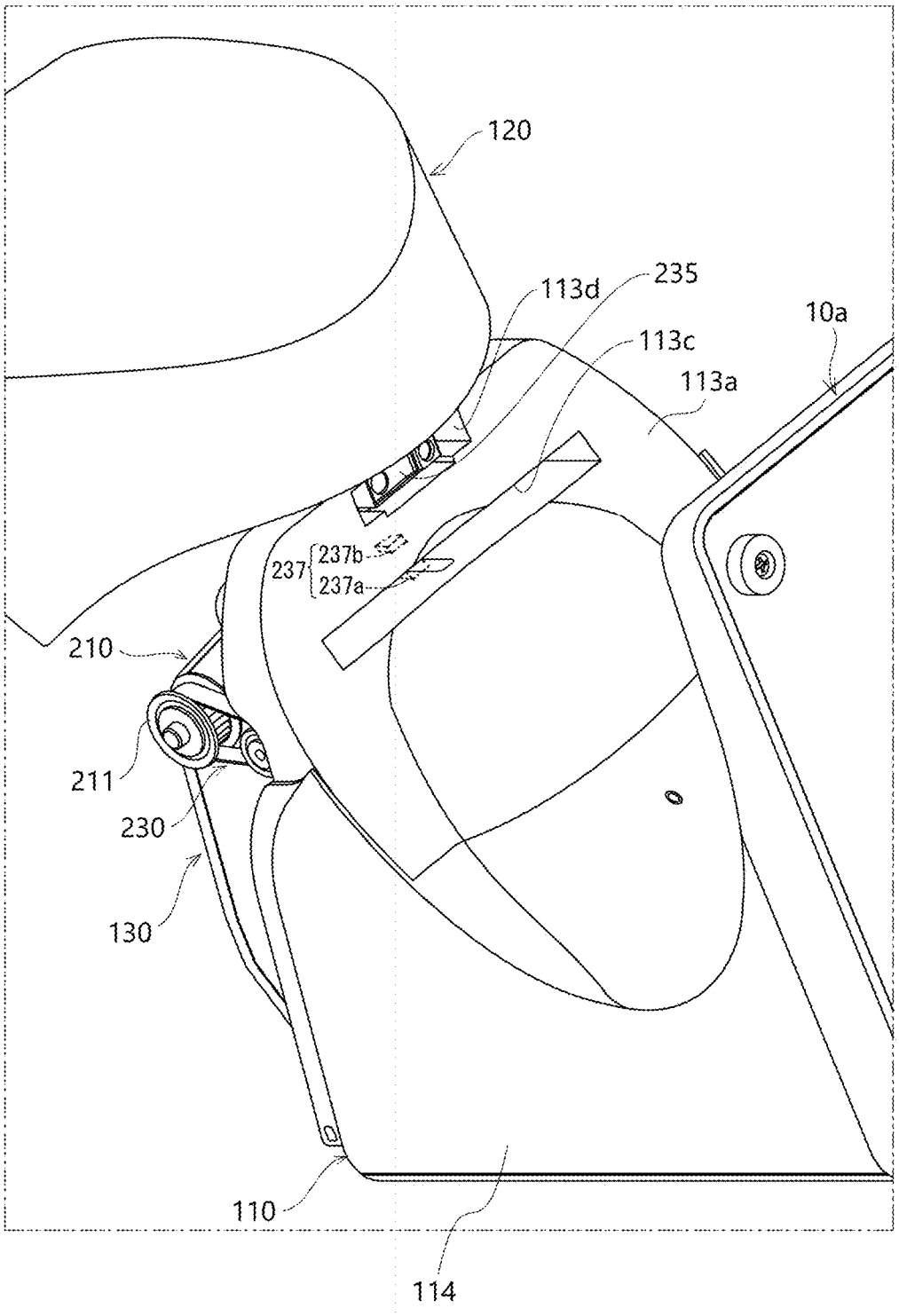
FIG. 6 is a perspective view illustrating a part of the sheet dispensing device seen from a sheet dispensing port side.

The feed amount control part 234 has a hand hovering sensor 235, a cutting line detecting sensor 236, a sheet detecting sensor 237, and a motor control part 238. The hand hovering sensor 235 detects the approach of some part of the user's body (which is usually a hand, but is not limited to the hand) to an appropriate place of the casing 10 in non-contact therewith (see FIG. 6). When the hand hovering sensor 235 detects the presence of a hand or the like, a signal is output from the motor control part 238 to rotate the motor 231. The hand hovering sensor 235 may be a sensor using light (including infrared rays) or ultrasonic wave and its kind is not limited. Further, the attachment position of the hand hovering sensor 235 is not limited either, and in this embodiment, as illustrated in FIG. 6 and FIG. 7, the hand hovering sensor 235 constituted by a reflective infrared sensor is provided in a hole 113*d* formed in the upper projecting surface 113*a* of the curved front surface 113 to be capable of detecting that a hand or the like is inserted to the front-side space 117 located under the sheet dispensing port 113*c*. As another possible configuration example, the hand hovering sensor 235 is provided on the top plate 121 or the peripheral wall 122 of the lid 120, the side surfaces 114, 114 of the main body case 110, or any other place, and detects a hand or the like not when the hand or the like is inserted to the front-side space 117 located under the sheet dispensing port 113*c* but when the hand or the like is held over an outer side of the hand hovering sensor 235 provided on the top plate 121 of the lid 120 or the other place.

The cutting line detecting sensor 236 is disposed upstream in terms of the feeding direction, and the sheet detecting sensor 237 is disposed downstream in terms of the feeding direction, with a contact point A between the driving roller 210 and the driven roller 220 (see FIG. 7 and FIG. 8) sandwiched therebetween. Note that the contact point A is a point where the driving roller 210 and the driven roller 220 are in contact with each other with the wet sheet S sandwiched therebetween, and when at least either of their surfaces is made of a material such as flexible rubber, a range where the two are in contact with each other with the wet sheet S sandwiched therebetween is sometimes not a point. In this case, in the range where the two are in contact with each other, a position across which a virtual line connecting a center point C1 of the driving roller 210 and a center point C2 of the driven roller 220 goes is set as the contact point A in this embodiment (see FIG. 7 and FIG. 8).

Specifically, the cutting line detecting sensor 236 is provided between the pullout port 131*a* of the sheet cartridge 130 and the contact point A between the driving roller 210 and the driven roller 220. The cutting line detecting sensor 236 is constituted by an optical sensor (including an infrared sensor), for example, and a light emitting part 236*a* and a light receiving part 236*b* are disposed to face each other with the wet sheet S passing between the driving roller 210 and the driven roller 220 sandwiched therebetween. The cutting line detecting sensor 236 detects the cutting line according to whether or not light passes through an opening S11 of a cutting line S1 (perforations) (see FIG. 8).

Specifically, the sheet detecting sensor 237 is provided between the contact point A between the driving roller 210 and the driven roller 220, and, the sheet dispensing port 113*c*. The sheet detecting sensor 237 is also constituted by an optical sensor (including an infrared sensor), for example, and a light emitting part 237*a* and a light receiving part 237*b* are disposed to face each other with the wet sheet S passing between the driving roller 210 and the driven roller 220 sandwiched therebetween. The sheet detecting sensor 237 detects the presence/absence of the wet sheet S according to whether or not light is blocked by the wet sheet S.

The motor control part 238 includes a board on which various electronic circuits are mounted, and is disposed at an appropriate position in the casing 10. The motor control part 238 receives detection signals from the hand hovering sensor 235, the cutting line detecting sensor 236, the sheet detecting sensor 237, and so on, and based on them, outputs a control signal to the motor 231.

Figure 11:
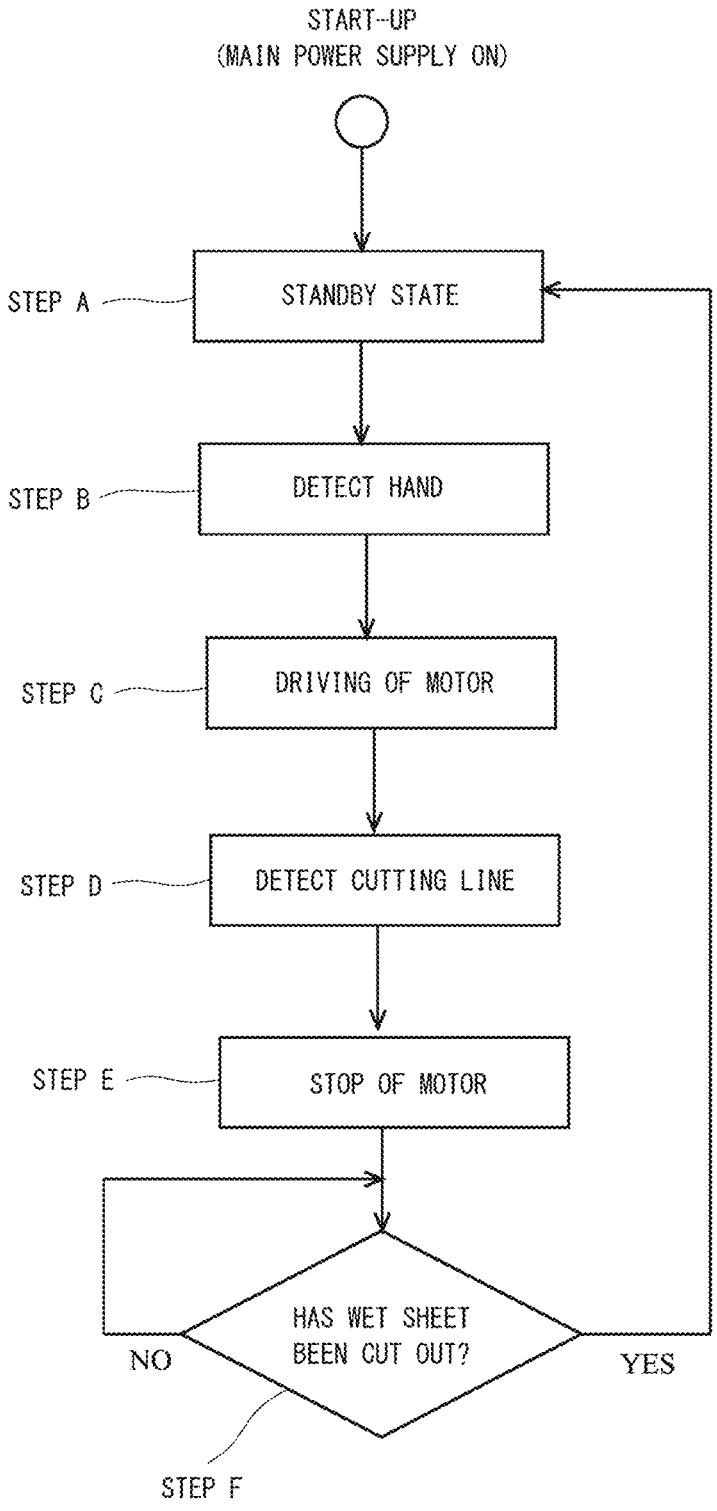
FIG. 11 is a flowchart for explaining an operation of the sheet dispensing device.

In this embodiment, as illustrated in FIG. 11, after setting the sheet cartridge 130 or the like, a main power supply is turned ON, which brings the wet sheet dispensing device 1 into a standby state (Step A in FIG. 11). Thereafter, when the hand hovering sensor 235 detects a hand (Step B in FIG. 11), the motor control part 238 receives a detection signal therefrom, and outputs a drive signal to the motor 231. This drives the motor 231 to rotate the driving roller 210 (Step C in FIG. 11). Note that in this explanation, the wet sheet S for one-time use (reference signs Sa, Sb in FIG. 8) is set as one sheet located between the adjacent cutting lines S1, S1.

While the wet sheet S is fed, the cutting line detecting sensor 236 detects the next passing cutting line S1 (the opening S11 of perforations) (Step D in FIG. 11). When the motor control part 238 receives a detection signal of this cutting line S1, it outputs a signal to stop the driving of the motor 231 after a predetermined time set beforehand has elapsed (Step E). This stops the rotation of the driving roller 210. In this embodiment, after the motor control part 238 receives the detection signal of the cutting line S1, the predetermined time until the motor 231 is stopped is set to, at the time in which the predetermined time has elapsed from the timing at which the cutting line detecting sensor 236 detects the cutting line S1, make the detected cutting line S1 reach a range downstream of the contact point A between the driving roller 210 and the driven roller 220 and upstream of the attachment position of the sheet detecting sensor 237 (detection position) in terms of the feeding direction. Accordingly, a part sandwiched between the driving roller 210 and the driven roller 220 (the center of the sandwiched part is the contact point A between the two) is always upstream of the cutting line S1 in terms of the feeding direction.

Figure 8:
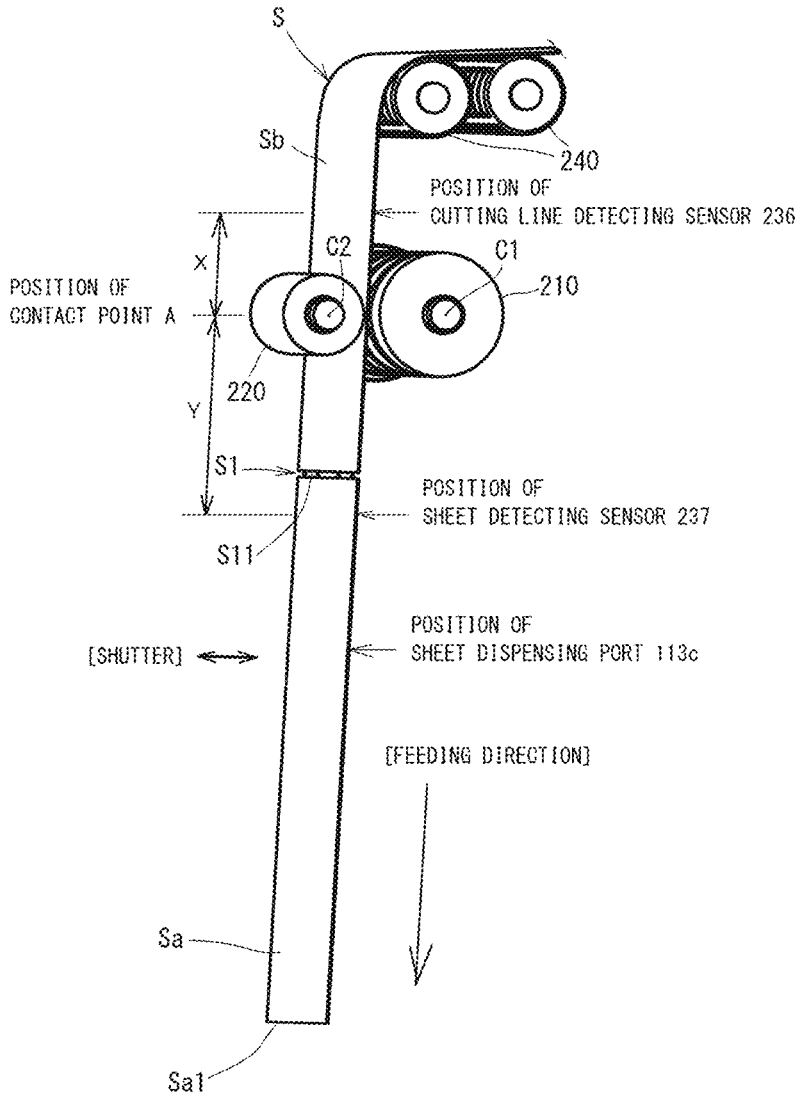
FIG. 8 is an explanatory view of arrangement positions of a wet sheet, a cutting line, the driving roller and a driven roller, a cutting line detecting sensor, and a sheet detecting sensor.

FIG. 8 illustrates a state in which for use of a preceding wet sheet Sa, its leading edge Sal side projects downward from the sheet dispensing port 113*c*. As illustrated in FIG. 8, the cutting line S1 between the two wet sheets Sa, Sb is downstream of the contact point A between the driving roller 210 and the driven roller 220 in terms of the feeding direction. At this time, the sheet detecting sensor 237 detects the presence of the preceding wet sheet Sa, and is in a state of waiting for this wet sheet Sa to be pulled down and taken out by a user (Step F in FIG. 11). In this state, the preceding wet sheet Sa is taken for use. Then, the sheet detecting sensor 237 is in a state of not detecting the presence of the preceding wet sheet Sa. This brings the standby state again (Step A in FIG. 11).

Here, the wet sheet S to be fed by the sheet feeding mechanism 20 is rolled in the sheet cartridge 130. Therefore, a roll diameter of the wet sheet S gradually decreases from the time of the beginning of use, which reduces its weight. At this time, as a characteristic of the wet sheet S, various kinds of water, which are different depending on uses, such as a disinfectant, a sterilizer, and a cleaning agent are contained, and hence between immediately after the beginning of use and immediately before the end of use, a difference in weight is significantly larger as compared with a sheet containing no water. Thus, feed resistances of the wet sheet S fed by rotation of the driving roller 210 vary greatly between immediately after the beginning of use and immediately before the end of use, and as in this embodiment, in the motor control part 238, after the cutting line detecting sensor 236 detects the cutting line S1, in a case of performing such time control as to stop the driving of the motor 231 at the time when the predetermined time has elapsed, its feed rate is the slowest at the time of the maximum feed resistance immediately after the beginning of use and is the fastest at the time of minimum feed resistance immediately before the end of use, and, a difference between the two feed rates is large.

In this embodiment, as described above, the motor control part 238 is required to perform, after receiving the detection signal of the cutting line S1, within the predetermined time until the motor 231 is stopped, such control as to locate the detected cutting line S1 between the contact point A between the driving roller 210 and the driven roller 220, and, the attachment position of the sheet detecting sensor 237 (detection position). Accordingly, from such a characteristic of the rolled wet sheet S containing water as described above, when feed resistance is high, after the cutting line detecting sensor 236 detects the cutting line S1, there is a possibility that it does not reach the side downstream of the contact point A between the driving roller 210 and the driven roller 220 within the predetermined set time. In this case, even though a part projecting from the sheet dispensing port 113*c* is pulled down, the wet sheet S fails to be cut out from the detected cutting line S1. On the other hand, a decrease in feed resistance increases the feed rate of the wet sheet S, and after the cutting line detecting sensor 236 detects the cutting line S1, there is also a possibility that it reaches the side downstream of the attachment position of the sheet detecting sensor 237 (detection position) in terms of the feeding direction after the predetermined set time has elapsed. In this case, even though the wet sheet S projecting from the sheet dispensing port 113*c* and located at the front thereof is pulled, the wet sheet S is cut out from the cutting line S1 located below the sheet detecting sensor 237, resulting in that the sheet detecting sensor 237 still continues detecting the presence of the wet sheet S. When the sheet detecting sensor 237 does not detect the presence of the wet sheet S, the motor control part 238 detects that the wet sheet S has been taken, which brings the wet sheet dispensing device 1 into the standby state (Step A in FIG. 11), but when the sheet detecting sensor 237 continues detecting the presence of the wet sheet S, a state of waiting for the wet sheet S to be taken continues (Step F in FIG. 11), which causes a failure to make transition to the standby state (Step A in FIG. 11). As a result, even though the hand hovering sensor 235 detects the next user's hand, the motor 231 does not drive to cause an operation error.

Thus, an attachment position of the cutting line detecting sensor 236 (detection position) is set so that a separation distance X (see FIG. 8) from the contact point A between the driving roller 210 and the driven roller 220 is a distance which, at the maximum, within the predetermined time set beforehand until the driving of the motor 231 stops, at the time of maximum feed resistance of the wet sheet S, that is, immediately after the beginning of use (the first one is pulled out of the rolled wet sheet S, and is in a state in which its leading edge is set to, from between the driving roller 210 and the driven roller 220, face the side downstream of them), after the cutting line detecting sensor 236 detects the cutting line S1 between the first one and the second one, allows this detected cutting line S1 to reach the side downstream (downstream at the time of passing over the position at the contact point A) of the contact point A between the driving roller 210 and the driven roller 220 in terms of the feeding direction. That is, as long as on the basis of the time of maximum feed resistance, the separation distance X is set to equal to or shorter than a distance through which the cutting line S1 can pass the contact point A within the predetermined time set beforehand until the motor 231 stops, the feed resistance is only reduced thereafter by the use, which prevents the position of the detected cutting line S1 from stopping short of the contact point A.

On the other hand, the attachment position of the sheet detecting sensor 237 (detection position) is set to a position which a separation distance Y (see FIG. 8) from the contact point A between the driving roller 210 and the driven roller 220 makes, at the minimum, at the time of stopping the driving of the motor 231 after the predetermined time set beforehand has elapsed, at the time of minimum feed resistance of the wet sheet S, that is, immediately before the end of use (the time when the cutting line S1 between the second last one and the last one in the rolled wet sheet S is detected by the cutting line detecting sensor 236), the detected cutting line S1 reach. At the time of the minimum feed resistance, since a fixed time until the driving of the motor 231 stops is given, a moving distance is longer than that at the time of the maximum feed resistance. Accordingly, a reaching position of the cutting line S1 at this time is downstream of the contact point A between the driving roller 210 and the driven roller 220, while it is located apart from the contact point A as compared with the phase of higher resistance than that at the time of the minimum feed resistance. Therefore, by setting the separation distance Y to be a distance equal to or more than the reaching position, even though the feed resistance gradually decreases, the cutting line S1 detected by the cutting line detecting sensor 236 is prevented from reaching the side downstream of the attachment position of the sheet detecting sensor 237 in terms of the feeding direction.

The attachment positions of the cutting line detecting sensor 236 and the sheet detecting sensor 237 are set under the above-described conditions, thereby allowing secure feeding of the rolled wet sheet S having the characteristic of the feed resistances greatly different between immediately after the beginning of use and immediately before the end of use. That is, regardless of the remaining amount of the wet sheet S, the position of the cutting line S1 on the wet sheet S stays between the contact point A between the driving roller 210 and the driven roller 220, and, the attachment position of the sheet detecting sensor 237 (detection position), which allows the sheet detecting sensor 237 to detect the absence of the wet sheet S more securely when a user cuts out the wet sheet S projecting from the sheet dispensing port 113*c*, resulting in preventing a malfunction.

In this embodiment, as described above, in the standby state (Step A in FIG. 11), the cutting line S1 is located between the contact point A between the driving roller 210 and the driven roller 220, and, the sheet dispensing port 113*c*. That is, the leading edge of the wet sheet S to be taken by the next user does not project outside from the sheet dispensing port 113*c*. Accordingly, outside air or air from an air conditioner does not directly hit the wet sheet S to be taken by the next user, which enhances the effect of preventing drying. Meanwhile, through the sheet dispensing port 113*c*, the range downstream of the contact point A between the driving roller 210 and the driven roller 220 tends to be more easily dried as compared with the one upstream of the contact point A. Thus, to also prevent the drying in the ranges, in the standby state, a shutter which closes the sheet dispensing port 113*c* can also be provided (see FIG. 8). At the time of normal operation, a conventional structure such that the wet sheet S projects from the sheet dispensing port 113*c* in the standby state fails to provide such a shutter, but in the case where the wet sheet S does not project from the sheet dispensing port 113*c* in the standby state as in this embodiment, such a shatter can be provided to further enhance the effect of preventing drying.

Figure 10:
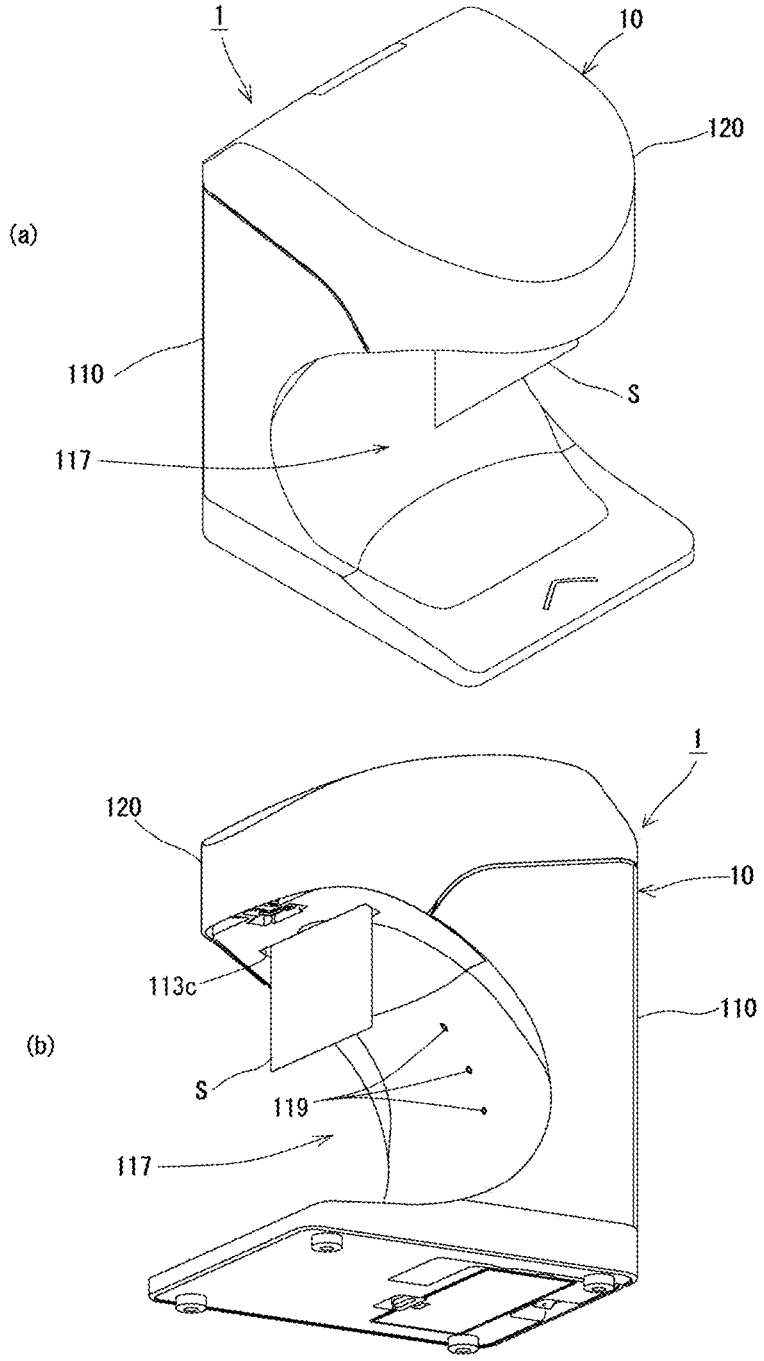
FIG. 10(*a*) is a perspective view of the sheet dispensing device in a wet sheet projecting state seen from a front upper direction, and FIG. 10(*b*) is a perspective view of the sheet dispensing device in the wet sheet projecting state seen from a front lower direction.

In addition, in a state in which the wet sheet S projects from the sheet dispensing port 113*c* and waits for a user to take the wet sheet S (see FIGS. 10(*a*), (*b*)), in order to inform the user that the wet sheet S hangs down from the sheet dispensing port 113*c*, it is preferable to receive a signal from the sheet detecting sensor 237, and irradiate the hanging wet sheet S with light by providing light irradiation parts 119 such as LEDs in the curved front surface 113 of the casing 10 as illustrated in FIG. 10(*b*). As the light from the light irradiation parts 119, for example, the three light irradiation parts 119 are shone sequentially from the top to the bottom, or the like to project the light on the wet sheet S, to which the user's attention is called, resulting in allowing prevention of him/her from forgetting to take it.

Figure 4:
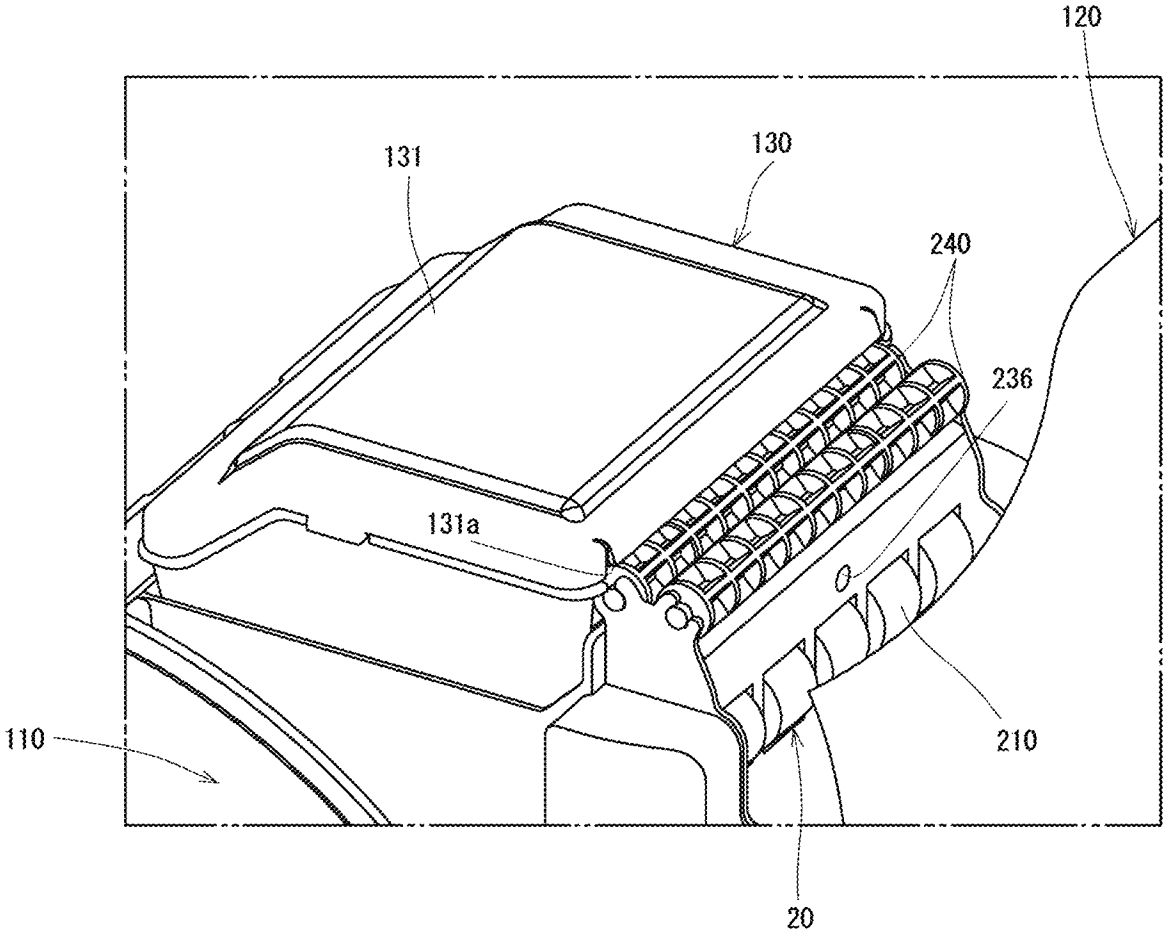
FIG. 4 is an enlarged view illustrating a range from a sheet cartridge to a driving roller seen from an oblique upper direction.
Figure 5:
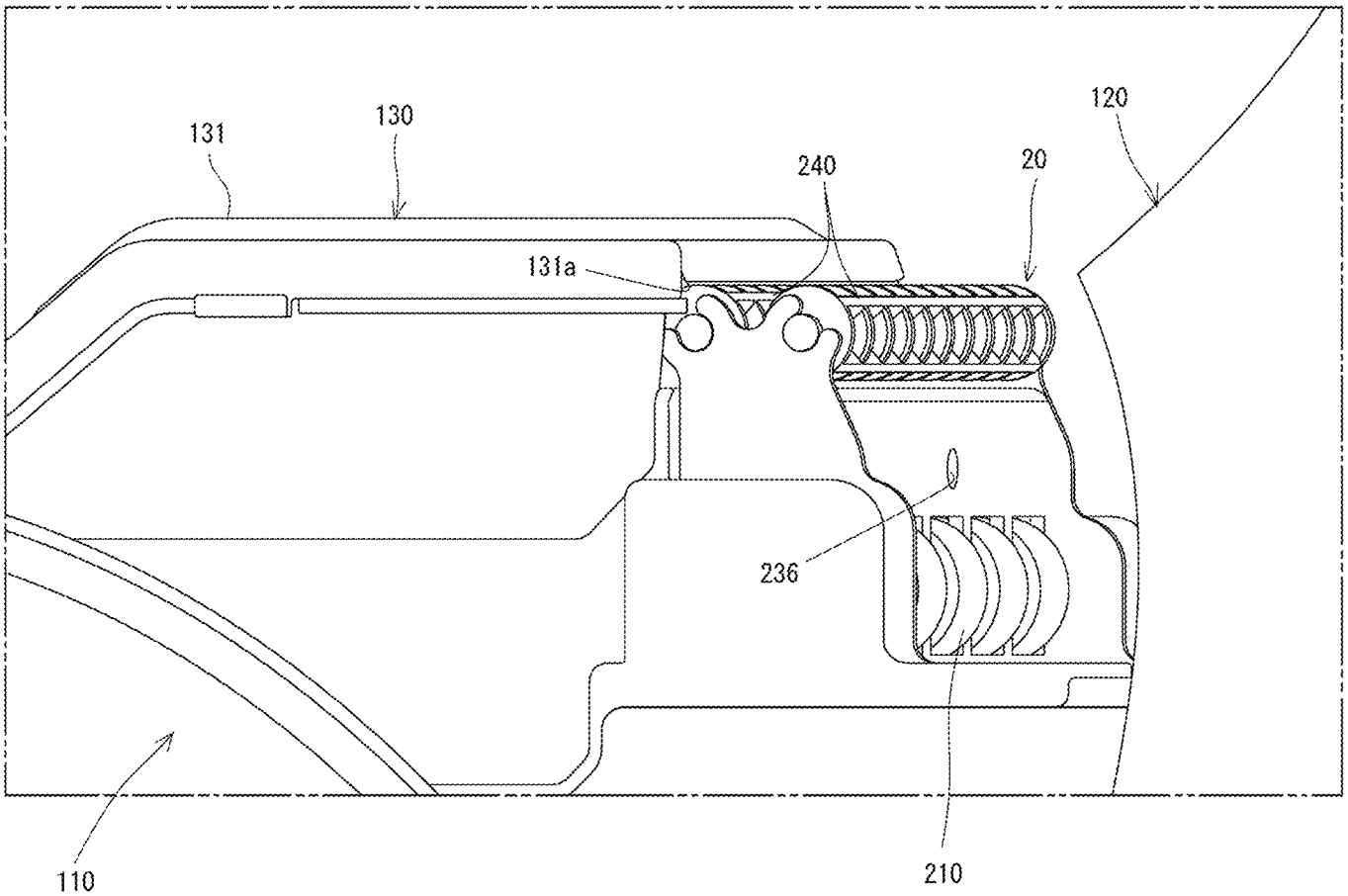
FIG. 5 is an enlarged view illustrating the range from the sheet cartridge to the driving roller seen from a lateral direction.

Further, the driving roller 210 and the driven roller 220 are disposed above the sheet dispensing port 113*c* and below the height of the pullout port 131*a* of the sheet cartridge 130. Therefore, when the wet sheet S pulled out from the pullout port 131*a* is directly pulled by the driving roller 210 and the driven roller 220, there is a possibility that the wet sheet S fractures from the cutting line S1 before discharged from the sheet dispensing port 113*c*. Thus, in this embodiment, fracture preventing auxiliary rollers 240, 240 that catch the sheet S pulled out from the pullout port 131*a* at a position closer to the pullout port 131*a* than the driving roller 210 and the driven roller 220 are provided. The two fracture preventing auxiliary rollers are disposed in parallel in this embodiment (see FIG. 4, FIG. 5, and FIG. 7). This makes it possible to prevent the wet sheet S from, after being pulled out substantially horizontally from the pullout port 131*a*, due to a downward transfer thereof, being under too much tension immediately after being pulled out from the pullout port 131*a*. In particular, the fracture preventing auxiliary roller 240 close to the pullout port 131*a* is preferably disposed to partially face the pullout port 131*a* in a side view as illustrated in FIG. 4, FIG. 5, and FIG. 7. This makes it possible to further prevent the fracture of the cutting line S1 due to a sudden change of direction immediately after being pulled out from the pullout port 131*a*.

Figure 9:
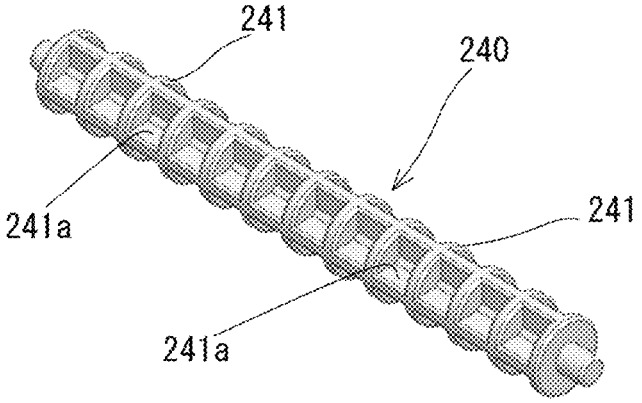
FIG. 9(*a*) is a perspective view illustrating a fracture preventing auxiliary roller, and FIG. 9(*b*) is a plan view of the sheet cartridge.
Figure 9:
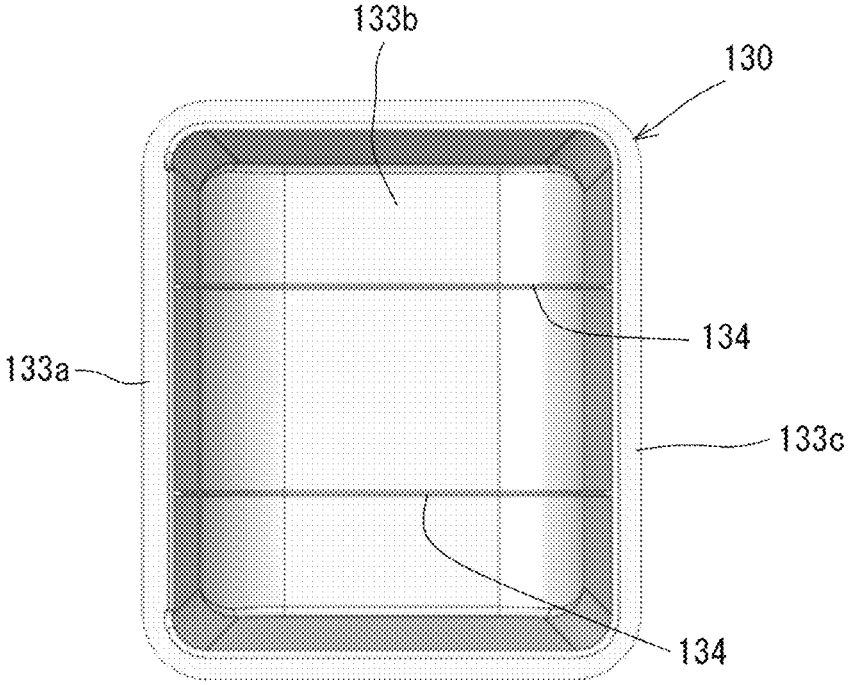

Note that as illustrated in FIG. 9(*a*), the fracture preventing auxiliary roller 240 preferably has a plurality of dents 241*a* on its peripheral surface 241 around which the wet sheet S is wound so that its contact area with the wet sheet S is as small as possible. As the contact area of the peripheral surface 241 of the fracture preventing auxiliary roller 240 and the wet sheet S is smaller, the sheet S is less easily stuck, and the effect of preventing the fracture from the cutting line S1 during the feeding is higher.

Further, when the wet sheet S is fed out, in the sheet cartridge 130, a rolled part of the wet sheet S rotates. A high resistance at the time of this rotation leads to an increased possibility of a fracture of a certain one of the cutting lines S1 due to the pulling force of the driving roller 210. Therefore, in the sheet cartridge 130, a rotation assisting means is preferably provided to make the rotation of the rolled sheet smooth. In this embodiment, as illustrated in FIG. 9(*b*), the rotation assisting means is constituted by one rib 134 or more formed to project on a front surface 133*a*, a bottom surface 133*b*, and a rear surface 133*c* and extend along the rotation direction of the rolled wet sheet S. In order to further reduce the rotational resistance, a number of the ribs 134 are preferably provided in parallel.

According to this embodiment, first, the lid 120 is opened, and the sheet cartridge 130 is placed on the sheet placement part 116 in the main body case 110 see FIG. 3 to FIG. 5). Next, the wet sheet S is pulled out from the pullout port 131*a*, and its leading edge is wound on the outer peripheral surface of the driving roller 210. At this time, the leading edge is wound so as to pass over the portion at the contact point A with the driven roller 220. Next, when the lid 120 is closed, the driven roller 220 faces the driving roller 210 with the wet sheet S sandwiched therebetween (see FIG. 7). Being biased by the leaf springs 222, the driven roller 220 is pressed toward the driving roller 210 with the wet sheet S sandwiched therebetween.

The outer appearance in the state set as above is as illustrated in FIG. 1 and FIG. 2, and the wet sheet S is not present in the front-side space 117. When a main power supply is turned ON in this state, the wet sheet dispensing device 1 of this embodiment is in the standby state (Step A in FIG. 11). Next, when the user inserts his/her hand or the like into the front-side space 117, the hand hovering sensor 235 detects this hand or the like (Step B in FIG. 11). Its detection signal makes the motor control part 238 drive the motor 231 (Step C in FIG. 11). Consequently, the driving roller 210 rotates, and accordingly the driven roller 220 rotates to transfer the wet sheet S.

When the wet sheet S is transferred, the cutting line detecting sensor 236 detects the cutting line S1 between the first wet sheet S (corresponding to the wet sheet Sa in FIG. 8) and the second wet sheet S (corresponding to the wet sheet Sb in FIG. 8) (Step D in FIG. 11). The motor control part 238 detects this cutting line S1, thereafter outputting the signal to stop the driving of the motor 231 after the predetermined time set beforehand has elapsed, which stops the rotation of the driving roller 210. This step is in the state in which the detected cutting line S1 passes through the contact point A between the driving roller 210 and the driven roller 220 to be downstream in the feeding direction, the sheet detecting sensor 237 detects the presence of the first wet sheet S (corresponding to the wet sheet Sa in FIG. 8) located in front of the cutting line S1, and the leading edge Sal of the first wet sheet S (corresponding to the wet sheet Sa in FIG. 8) projects from the sheet dispensing port 113*c* to the front-side space 117 (see FIGS. 10(*a*), (*b*)) to wait for the user to take (Step F in FIG. 11). At this time, in this embodiment, it is as described above that a positional relationship between the cutting line detecting sensor 236, and, the driving roller 210 and the driven roller 220 is set so that the cutting line S1 between the first wet sheet S (corresponding to the wet sheet Sa in FIG. 8) and the second wet sheet S (corresponding to the wet sheet Sb in FIG. 8) at the time of maximum feed resistance is assured that it passes through the contact point A between the driving roller 210 and the driven roller 220 to be downstream in terms of the feeding direction.

The first wet sheet S (the wet sheet Sa in FIG. 8) in the range projecting from the sheet dispensing port 113*c* to the front-side space 117 is irradiated with light from the light irradiation parts 119, and the light is projected thereon, which informs the user that the first wet sheet S (the wet sheet Sa in FIG. 8) has been prepared to be taken (see FIG. 10(*b*)).

Then, when the user pulls down the first wet sheet S (corresponding to the wet sheet Sa in FIG. 8) located in front of the cutting line S1 and projecting from the sheet dispensing port 113*c* to the front-side space 117, it is cut off from this cutting line S1 to be provided for the user because the second wet sheet S (corresponding to the wet sheet Sb in FIG. 8) located upstream of the cutting line S is sandwiched between the driving roller 210 and the driven roller 220. The user can take the wet sheet Sa with a predetermined length to wipe his/her own hands or the like without coming into contact with any portion other than the wet sheet Sa. Then, the sheet detecting sensor 237 fails to detect the presence of the first wet sheet S (corresponding to the wet sheet Sa in FIG. 8) located in front of the cutting line S1, and the drive control mechanism 230 is in the standby state with the motor 231 stopped (Step A in FIG. 11). In the standby state, the second wet sheet S to be provided next remains waiting at the position of the wet sheet Sb in FIG. 8, and does not project from the sheet dispensing port 113*c*. Therefore, there is no part projecting from the sheet dispensing port 113*c* to be directly exposed to outside air or air from an air conditioner, which makes drying difficult. Note that in this standby state, it is as described above that the shutter closes the sheet dispensing port 113*c*, thereby making drying more difficult.

The above-described operation is repeated so that when the next user holds his/her hand over the hand hovering sensor 235, the motor 231 rotates to cause rotation of the driving roller 210 and the driven roller 220, and the cutting line detecting sensor 236 detects the cutting line S1 between the second wet sheet S and the third wet sheet S, which are fed until this cutting line S1 passes through the contact point A between the driving roller 210 and the driven roller 220, resulting in providing the second wet sheet S located in front of this cutting line S1 for the user. Note that when the shutter is used, the drive control mechanism 230 moves the shutter to open the sheet dispensing port 113*c* immediately before driving the motor 231 from the standby state.

The wet sheet S is consumed in this manner, and as a remaining amount of the wet sheet S decreases, the feed resistance gradually decreases. This extends the distance in which the wet sheet S is transferred within the time set beforehand from the detection of the cutting line S1 at the cutting line detecting sensor 236 to the stop of the motor 231, but the sheet detecting sensor 237 is attached to match the time of minimum feed resistance as described above, which stops the motor 231 before the detected cutting line S1 passes through the sheet detecting sensor 237. This makes it difficult to cause the malfunction of no transition to the standby state with the sheet detecting sensor 237 detecting the presence of the wet sheet S, as described above.

Note that in the wet sheet dispensing device 1 of this embodiment, as described above, only at the time of use, only the front wet sheet S preceding the detected cutting line S1 (the wet sheet Sa in FIG. 8) projects from the sheet dispensing port 113*c*, and at the same time, without coming into contact with the base 10*a* located on the lower side, it is provided for the user in the hanging state (see FIG. 10(*a*), (*b*)). Despite having a hygienically excellent point where the wet sheet S does not come into contact with the base 10*a*, due to a detection error of the cutting line S1, or the like, there is also a possibility of causing the malfunction of transferring the wet sheet S at the front until coming into contact with the base 10*a*. Thus, to stop the driving of the motor 231 when such a malfunction occurs, when a projection length of the wet sheet S (the wet sheet Sa in FIG. 8) from the sheet dispensing port is equal to or longer than the predetermined length, a projection length abnormality detecting sensor (not illustrated) which outputs a signal to stop the driving of the motor 231 from the motor control part 238 can also be provided. The projection length abnormality detecting sensor can be provided on the curved front surface 113, for example.

Figure 12:
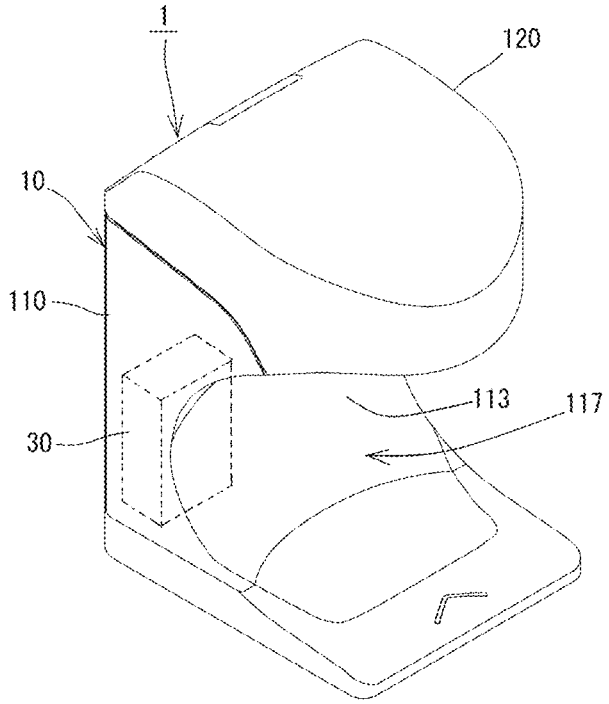
FIG. 12(*a*) is an explanatory view of a form in which an information processing part is provided in the sheet dispensing device, and FIG. 12(*b*) is a block diagram for explaining a configuration of the information processing part.
Figure 12:
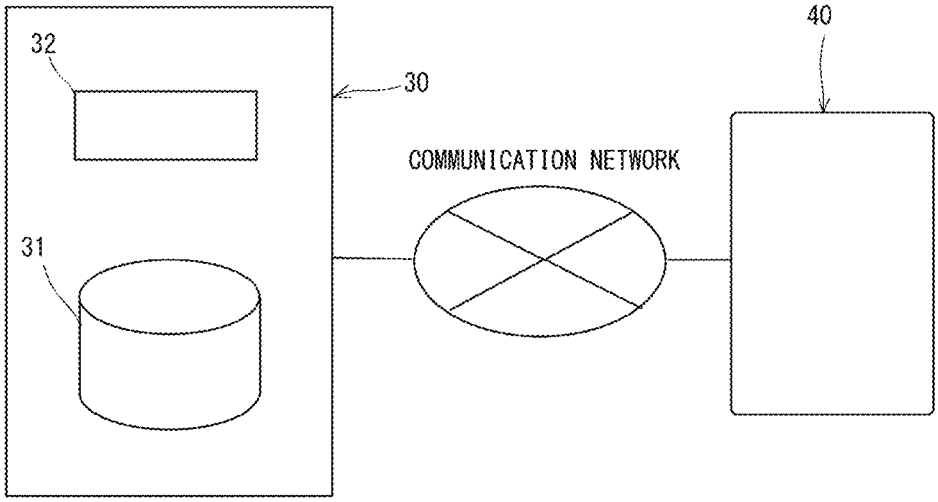

Further, as illustrated in FIGS. 12(*a*), (*b*), an information processing part 30 can also be provided in the casing 10. The information processing part 30 is constituted by a small computer having a storage unit 31 which stores device information including a using condition of the wet sheet S and abnormality of the operation, and a communication unit 32 having a function of reading out the device information from the storage unit 31 to transmit it via a communication network to a management computer 40, a control board mounting chips having their functions, or the like, and is provided for the casing 10 internally or externally. For example, it is possible that the sheet detecting sensor 237 counts the detection number of presences of the wet sheet S to store the detection number thereof in the storage unit 31, and the communication unit 32 reads out it regularly to transmit it to the management computer 40. The device information includes information regarding not only the number of the taken wet sheets S but also the time when the wet sheet S has been taken, a lack of sheets, abnormality, a remaining amount of battery, and the like. Note that the information on the lack of sheets and the abnormality, or the like is preferably set to be transmitted immediately after the occurrence thereof. Further, the communication network is not limited either, and for example, the Internet can be used via Wi-Fi, and without being limited to wireless connection, wired connection is available. In addition, the information processing part 30 can also be configured to receive instructions from the management computer 40 via the communication unit 32, start an operation mode of eliminating the abnormal state, or force a shutdown in an emergency.

Figure 13:
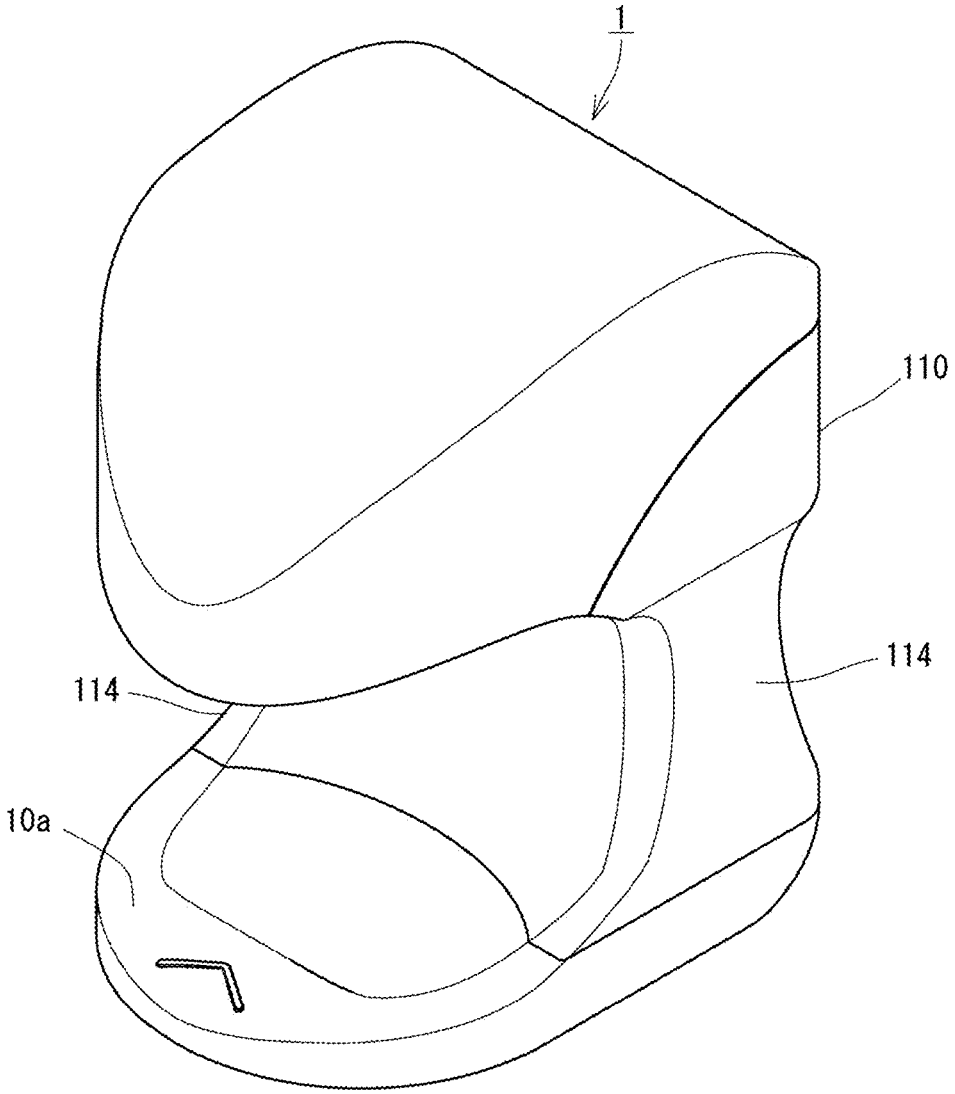
FIG. 13 is a perspective view illustrating a modification example of the outer shape of the sheet dispensing device.

Further, the shape of the sheet dispensing device 1 is not limited to that shown in the above, and as illustrated in FIG. 13, it can have a sophisticated design if, for example, the side surfaces 114, 114 of the main body case 110 are constricted inward at their middles so as to be curved, and the front portion of the base 10*a* is substantially arc-shaped.

INDUSTRIAL APPLICABILITY

The sheet dispensing device of the present invention is suitable for use not only in restrooms, washrooms, and so on where it is used by unspecified people but also in clinical sites, nursing and caring facilities, kitchens, seats of restaurants, hotels, department stores, seats of trains and airplanes, taxis, and so on that require high hygienic consideration.

The invention claimed is:

1. A wet sheet dispensing device comprising:

a casing capable of housing, inside, a sheet cartridge housing a rolled wet sheet provided with a cutting line in a width direction at predetermined intervals, and having a pullout port from which a wet sheet is pulled out, and, including a sheet dispensing port which is formed at a predetermined height position to face downward and through which the wet sheet passes when fed out; and a sheet feeding mechanism which is provided in the casing, pulls the wet sheet out of the sheet cartridge from the pullout port, and feeds out the wet sheet with a predetermined length for use from the sheet dispensing port, and dispenses the wet sheet with the predetermined length for use in a hanging state from the sheet dispensing port while holding a part located upstream of the sheet dispensing port in terms of a feeding direction of the wet sheet, the sheet feeding mechanism comprising:

a driving roller and a driven roller which are disposed upstream of the sheet dispensing port in terms of the feeding direction of the wet sheet, and face each other to sandwich the wet sheet; and a drive control mechanism having a motor which rotates the driving roller in such a direction as to feed the wet sheet toward the sheet dispensing port, and having a feed amount control part which controls a feed amount of the wet sheet, the feed amount control part comprising:

a hand hovering sensor;

a cutting line detecting sensor which is provided in a range from the pullout port of the sheet cartridge to a contact point between the driving roller and the driven roller, and detects a cutting line of the wet sheet;

a sheet detecting sensor which is provided in a range from the contact point between the driving roller and the driven roller to the sheet dispensing port, and detects presence or absence of the wet sheet in front of a detected cutting line; and a motor control part which, based on a detection signal from the hand hovering sensor, outputs a signal to drive the motor from a standby state, and after the cutting line detecting sensor detects the cutting line, when a predetermined time in which the detected cutting line reaches a range from the contact point between the driving roller and the driven roller to a detection position of the sheet detecting sensor has elapsed, outputs a signal to stop the driving of the motor, and the sheet detecting sensor detecting the presence of the wet sheet in a state in which the wet sheet in front of the detected cutting line hangs from the sheet dispensing port, and in the standby state, being in a state of not detecting the presence of the wet sheet after a hanging wet sheet is taken by a user;

wherein, at the sheet dispensing port, a shutter which closes the sheet dispensing port in the standby mode is provided.

2. The wet sheet dispensing device according to claim 1, wherein an attachment position of the cutting line detecting sensor is set to a position which, at a maximum apart from the contact point between the driving roller and the driven roller, at a time of maximum feed resistance of the wet sheet, allows the detected cutting line to reach a side downstream of the contact point between the driving roller and the driven roller in terms of the feeding direction until the predetermined time in which the driving of the motor stops has elapsed after detecting the cutting line, and wherein an attachment position of the sheet detecting sensor is set to a position which, at a minimum apart from the contact point between the driving roller and the driven roller, at a time of minimum feed resistance of the wet sheet, the detected cutting line reaches at a time when a predetermined time in which the driving of the motor stops has elapsed.

3. The wet sheet dispensing device according to claim 1, further comprising a light irradiation part which irradiates the hanging wet sheet from the sheet dispensing port with light while the sheet detecting sensor detects the presence of the wet sheet.

4. The wet sheet dispensing device according to claim 1, wherein a plurality of relay rollers for pullout which pull out the wet sheet substantially horizontally from the pullout port of a cover are disposed in parallel, and of the relay rollers, one closest to the pullout port is disposed to partially face the pullout port.

5. The wet sheet dispensing device according to claim 1, further comprising a projection length abnormality detecting sensor which outputs a signal to stop the driving of the motor when a projection length of the wet sheet from the sheet dispensing port is equal to or longer than a predetermined length.

6. The wet sheet dispensing device according to claim 1, further comprising an information processing part including:

a storage unit which stores device information including a using condition of the wet sheet and abnormality of operation; and a communication unit having a function of reading out the device information from the storage unit to transmit the device information to a management computer.

* * * * *